US010537763B2

(12) United States Patent
Turner

(10) Patent No.: US 10,537,763 B2
(45) Date of Patent: Jan. 21, 2020

(54) DEVICE FOR SUSPENDING RINGS FOR GYMNASTIC EXERCISES

(71) Applicant: Joseph Turner, San Antonio, TX (US)

(72) Inventor: Joseph Turner, San Antonio, TX (US)

( * ) Notice: Subject to any disclaimer, the term of this patent is extended or adjusted under 35 U.S.C. 154(b) by 0 days.

(21) Appl. No.: 14/201,617

(22) Filed: Mar. 7, 2014

(65) Prior Publication Data

US 2019/0076688 A1 Mar. 14, 2019

Related U.S. Application Data

(60) Provisional application No. 61/851,367, filed on Mar. 7, 2013.

(51) Int. Cl.

| | |
|---|---|
| ***A63B 7/02*** | (2006.01) |
| ***B65H 75/48*** | (2006.01) |
| ***A44B 11/12*** | (2006.01) |

(52) U.S. Cl.

CPC ..... *A63B 7/02* (2013.01); *A44B 11/12* (2013.01); *B65H 75/486* (2013.01); *A63B 2225/09* (2013.01)

(58) Field of Classification Search

CPC .... A63B 7/00; A63B 7/02; A63B 7/04; A63B 7/045; A63B 7/08; A63B 7/085; A63B 21/0004; A63B 21/00043; A63B 21/00185; A63B 21/002; A63B 21/0023; A63B 21/012; A63B 21/0125; A63B 21/015; A63B 21/018; A63B 21/02; A63B 21/021; A63B 21/022; A63B 21/023; A63B 21/025; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/065; A63B 21/068; A63B 21/08; A63B 21/15; A63B 21/151; A63B 21/153; A63B 21/154; A63B 21/155; A63B 21/156; A63B 21/157; A63B 21/16; A63B 21/1618; A63B 21/1627; A63B 21/1636; A63B 21/1645; A63B 21/1654; A63B 21/1663; A63B 21/1681; A63B 21/169; A63B 21/22; A63B 21/4023; A63B 21/4025; A63B 21/4027; A63B 21/4033; A63B 21/4035; A63B 21/4043; A63B 21/4045; A63B 21/4047; A63B 21/4049; A63B 22/0046; A63B 29/00; A63B 29/02; A63B 29/024; A63B 29/028; A63B 69/0064; A63B 71/0054;

(Continued)

(56) References Cited

U.S. PATENT DOCUMENTS 2,197,600 A * 4/1940 Wimer ..... A63B 7/00 254/338
2,596,648 A * 5/1952 Bugg ..... B65H 75/486 242/375.1

(Continued)

*Primary Examiner* — Gary D Urbiel Goldner
(74) *Attorney, Agent, or Firm* — Kammer Browning PLLC

(57) ABSTRACT

A device for suspending gymnastic rings and handles is described. The device has a power spring to automatically retract a strap onto a spool. There is a cam buckle that holds the strap in place at a desired height. There are marks on the strap to use as reference to easily match the rings to the same height. The device is typically used as a pair, one device for each ring. Many handle and bars can be attached.

5 Claims, 5 Drawing Sheets

(58) Field of Classification Search
CPC .... A63B 2071/0694; A63B 2208/0285; A63B 2208/029; A63B 2208/0295; A63B 2210/00; A63B 2210/50; A63B 2225/09; A63B 2225/093; A44B 11/12; B65H 75/486
See application file for complete search history.

(56) References Cited

U.S. PATENT DOCUMENTS 3,049,317 A * 8/1962 Kessler ..... A47H 3/12 185/37
3,402,901 A * 9/1968 Van Houten ..... B65H 75/38 242/378.3
3,437,105 A * 4/1969 Stracek ..... B65H 75/4478 137/355.23
3,482,798 A * 12/1969 Kawaguchi ..... B65H 75/486 242/292
3,773,987 A * 11/1973 Davis ..... B65H 75/4431 191/12.4
4,083,512 A * 4/1978 Rumpf ..... B60R 22/405 242/383.4
4,402,472 A * 9/1983 Burtscher ..... A01K 27/004 185/37
4,531,688 A * 7/1985 Gall ..... B65H 75/486 242/375
4,756,087 A * 7/1988 Sing ..... G01B 3/1005 242/384.7
4,913,371 A * 4/1990 Margetts ..... B65H 75/44 188/82.77
4,948,119 A * 8/1990 Robertson, Jr. ..... A63B 21/015 482/116
5,429,572 A * 7/1995 Brown ..... A63B 21/015 482/116
5,618,249 A * 4/1997 Marshall ..... A63B 21/153 482/115
7,112,165 B1 * 9/2006 Forsberg ..... A63B 21/153 482/110
8,075,453 B1 * 12/2011 Wilkinson ..... A63B 22/0005 482/51
2002/0160891 A1 * 10/2002 Gallagher ..... A63B 21/04 482/123
2003/0054924 A1 * 3/2003 Amore ..... A63B 21/015 482/92
2005/0124471 A1 * 6/2005 Wilkinson ..... A63B 21/00065 482/121
2012/0116259 A1 * 5/2012 McConnell ..... A63B 21/153 600/595
2014/0024508 A1 * 1/2014 Hinds ..... A63B 21/02 482/129
2014/0026373 A1 * 1/2014 Seader ..... A44B 11/12 24/193

* cited by examiner

DEVICE FOR SUSPENDING RINGS FOR GYMNASTIC EXERCISES

CROSS REFERENCES TO RELATED APPLICATIONS

This application claims the benefit under Title 35 United States Code 119 (e) of the U.S. Provisional Application 61/851,367 filed Mar. 7, 2013. The full disclosure of which is incorporated herein by reference.

BACKGROUND OF THE INVENTION

1. Field of the Invention

The present invention relates generally to exercise devices. The present invention relates more specifically to suspension devices, acrobatic apparatus where the user may hang freely by short handles bars or rings.

2. Description of Related Art

The use of rings or handles hanging from a ceiling or elevated apparatus is common in exercise classes where the user is suspended from the rings or handles to perform pull-ups, muscle-ups or other body weight exercises. Other exercises also performed on the rings such as "L" sits, where the user holds an acrobatic body position in which all the body weight rests on the hands with the torso held in a slightly forward leaning orientation, with legs held horizontally so that each leg forms a nominal right angle with the torso. The right angle causes the body to have a notable "L" shape to it.

For pull-ups the rings must be higher off the ground. Than for "L" sits. Often times the rings must be adjusted to different heights for different exercises during the same workout session. For example 8' for pull-ups and 3' for "L" sits.

One method to adjust the rings to different heights involves ridged arms, where the straps are attached to the rings at one end and the rigid arms above. The structure is elevated and adjusted up and down as desired.

The device is typically expensive and requires a higher ceiling for adjustment because the length of the suspension straps is not adjusted. They remain at fixed lengths while the rigid arms are raised up to elevate the rings.

A different method, which is the most common method for mounting and adjusting rings and handles to the ceiling, uses a simple setup which is a strap looped over the ceiling rafter and through the ring. The height of the rings is adjusted using a cam buckle attached to one end of the strap and the loose end of the strap is clamped in the cam buckle to adjust for the desired length.

There are two main problems with this method. The first being the extra strap is hanging in the way of the user and presents a hazard. The strap can become tangled on the users foot and injure them when the user dismounts the rings.

The typical method to counteract the problem of the extra strap is to take the time to neatly roll it up and tie it to the rafters or at least up and out of the way. This takes a good bit of time and must be done in between different exercises.

The second problem is that it is difficult to adjust each ring to the same height, unless one uses a measuring tape, or some other measuring device or method. This takes time and is difficult to do when one is exhausted but trying to keep their heart rate up by switching to the next exercise quickly.

It would be desirable to provide an inexpensive, simple system that can adjust the height of the rings quickly and accurately. It would further be desirable if the system automatically collects and stored the extra strap out of the way of the user.

SUMMARY OF THE INVENTION

In fulfillment of the above and other objectives, the present invention provides a device that supports rings that are suspended from an elevated structure. The device adjusts quickly, accurately and automatically coils extra strap out of the way of the user.

The frame of the device supports a cam buckle, a spinning spool that is spring loaded with a power spring to retract the strap, and a strap that has numbered marks at regular intervals to facilitate setting each device to the same height.

The devices are generally used in pairs and each rings is adjusted independently. The pair of devices would generally be mounted side by side approximately 24 inches apart, about 9 or 10 feet above the exercise surface. Fully extended the rings attached to the end of the strap can be adjusted all the way to the ground to facilitate exercises near the ground such as ring supported pushups.

The spool spins about a shaft that is attached to the frame. A power spring is wound about the shaft. One end of the spring is attached to the spool. The other end is attached to the frame. When the strap is pulled out as far as it will go, the spring is at its minimum tension. When the cam buckle is disengaged the spring retracts and rotates the spool winding up the strap. When the strap is fully wound up the spring is at minimum tension.

As oriented when hung for us, the features of the device from top to bottom are; a mounting hole, the spool assembly with the strap leading out and down through the cam buckle that is located below the spool on the frame. The strap end is then attached to a gymnastic ring, or handle or trapeze bar.

DETAILED DESCRIPTION OF THE PREFERRED EMBODIMENT

Figure 1:
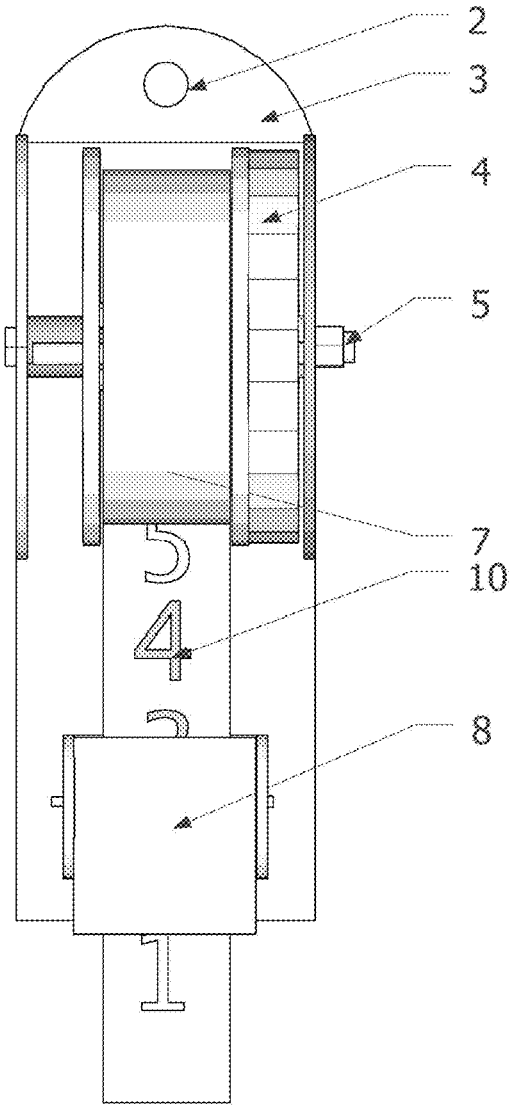
FIG. 1 is a front view of the device of the present invention.
Figure 2:
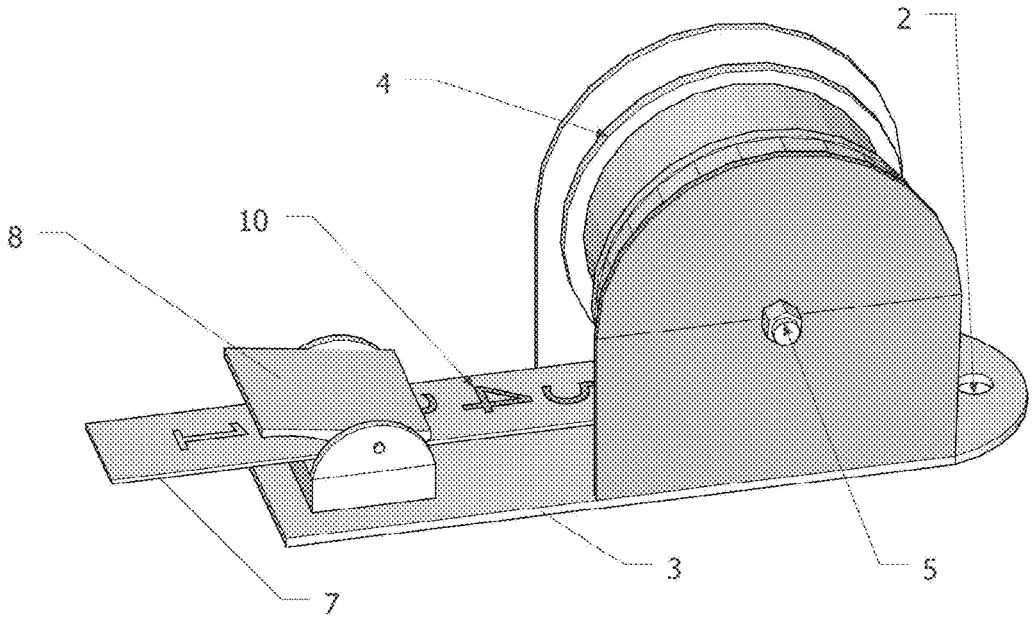
FIG. 2 is a perspective view of the device of the present invention.
Figure 3:
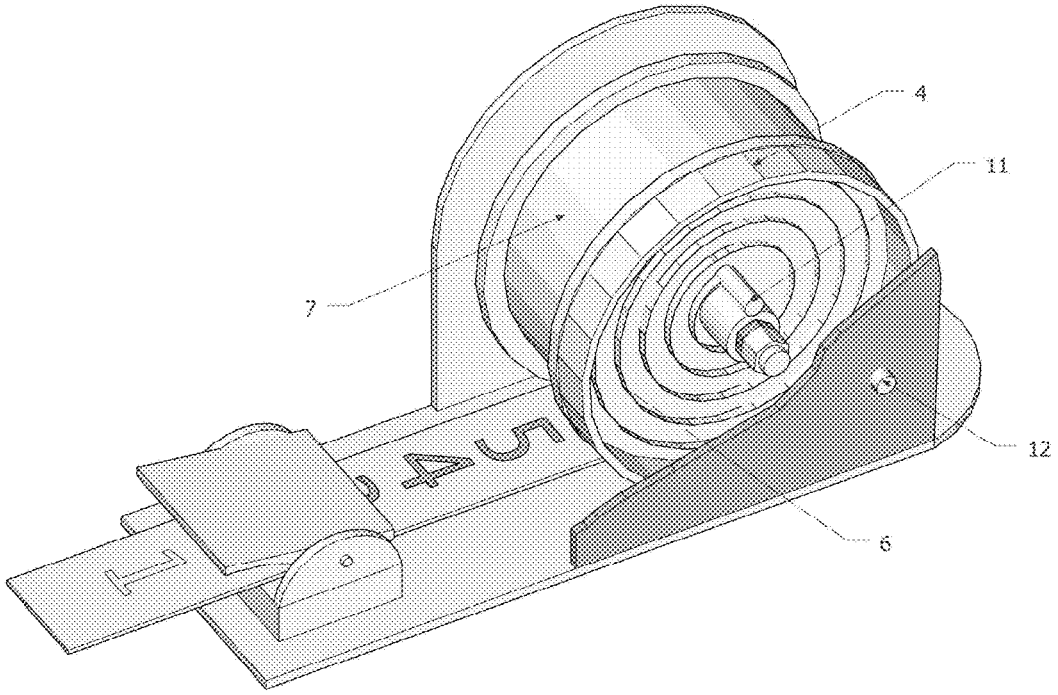
FIG. 3 is a perspective view with a section of the frame removed to show the power spring in the spool.
Figure 4:
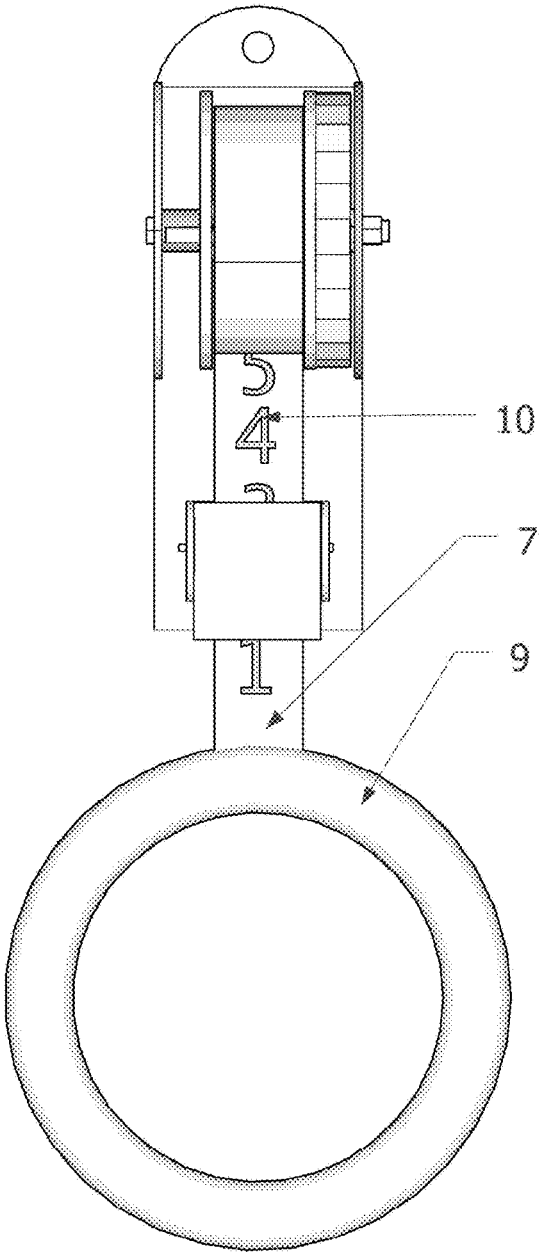
FIG. 4 is a front view showing a typical gymnastic ring attached.
Figure 5:
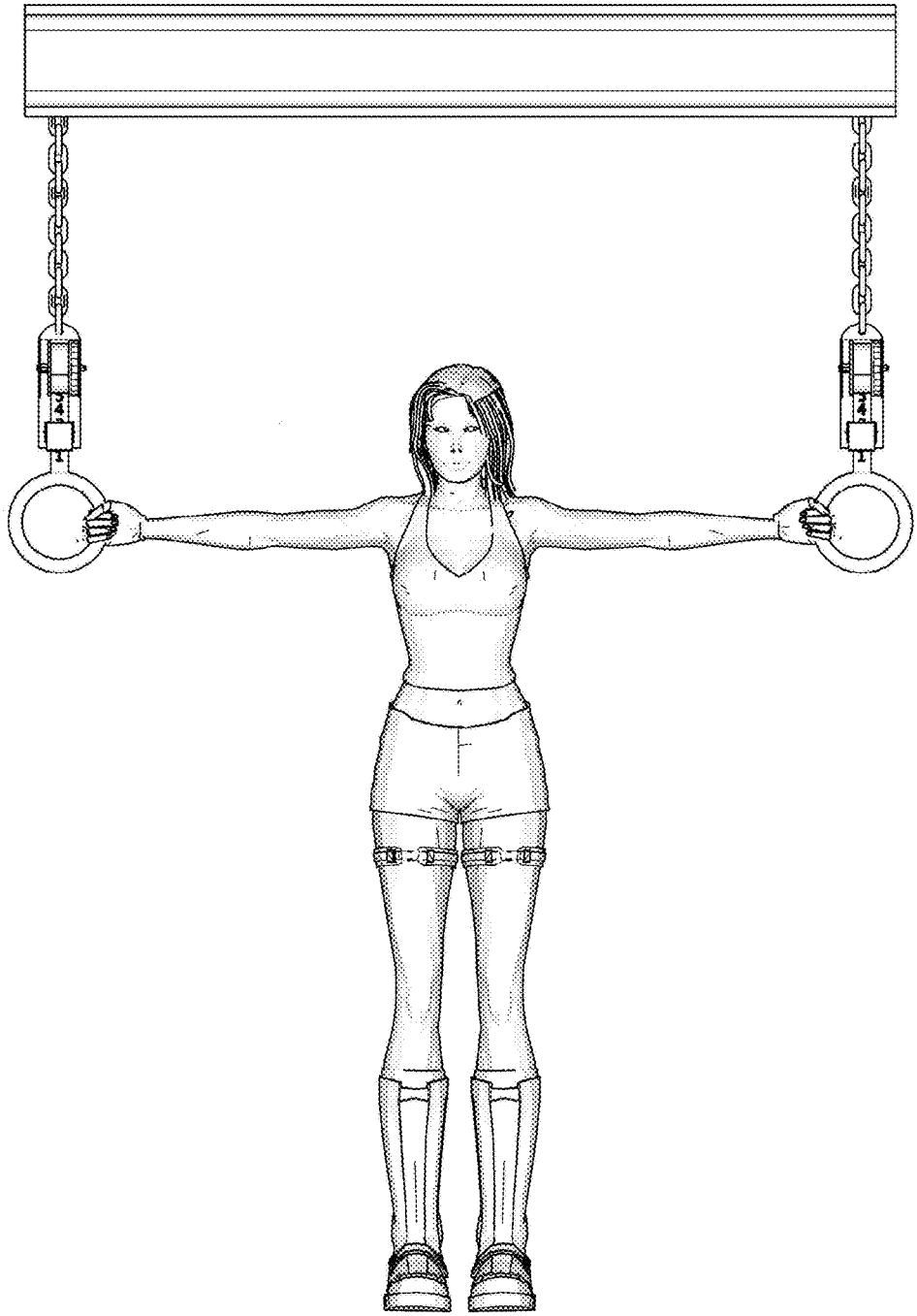
FIG. 5 shows a typical installation.

Reference is first made to FIG. 1 for a description of the overall system of the present invention. As indicated above, the device of the present invention is intended to hang gymnastic rings from an elevated mounting place above an exercise surface. The device is intended to provide a means for quick and accurate adjustment of the rings height as well as coil up and store the extra strap out of the way of the user.

A pair of the devices of the present invention are operated as follows. The user depresses the cam buckle 8 with one hand to allow the strap 7 to move through the cam buckle 8. The user grasps the ring 9 or strap 7 with the other hand and raises or lowers the ring 8 to the desired height. The user then releases the cam buckle 8 clamping the strap 7 in place. Making note of which numbered mark 10 on the strap 7 the device is set at, the process is repeated with the other device and set to the same numbered mark 10 to ensure each ring 9 is at the same height from the ground.

The cam buckle 8 is typically spring loaded and increases its clamping force on the strap 7 when pulled in one direction. The cam buckle 8, is facing so when the strap 7 is pulled down the cam buckle 8 clamps tighter on the strap 7. When a user depresses the cam buckle 8, it unclamps and allows the strap 7 to move through it freely. The strap 7 will start recoiling automatically because of the tension of the power spring 6.

The power spring 6 is wound about the shaft 5. One end attaches to the spool 7 by means of spool/spring attachment pin 11. The other end of the spring 6 is attached to the frame by means of a frame/spring attachment pin 12. During assembly of the device a number of pre-tensioning rotations are performed on the spool 4 to cause the strap 7 to be under tension even when the strap 7 is fully retracted into the device. The spool 4 is rotated in the direction of rotation that pays out strap 7, then the strap 7 is fed through the cam buckle 8 and attached to the ring 9.

I claim:

1. A system for vertically suspending at least one hand grasped device from an elevated structure and allowing for variations in a height of the at least one hand grasped device, the at least one hand grasped device including an exercise ring, the system comprising:

a device frame having an upper end defining a point of attachment for fixed suspension from the elevated structure;

a cam buckle supported by and positioned on a lower end of the device frame, the cam buckle having a pivot axle;

a spool having a rotation axle, the spool axially supported on the device frame at a position between the upper end and the lower end of the device frame;

a coil power spring fixed to the device frame, the coil power spring gearlessly and peripherally coupled to the spool; and a strap wound onto the spool, the strap comprising indicia spaced at regular intervals to facilitate setting a plurality of the at least one hand grasped device to a same height, the strap extending from the spool towards the lower end of the device frame, the strap having a lower end extending from within the cam buckle to a point of attachment on the at least one hand grasped device;

wherein release of the cam buckle allows the strap to be drawn out from the spool or alternately retracted back onto the spool, wherein closure of the cam buckle prevents the strap from movement therethrough in at least a downward direction, and wherein the coil power spring serves to preference the retraction of the strap back onto the spool after being drawn out from the spool when the cam buckle is released.

2. The system of claim 1 further comprising a length of linked chain secured at an upper end thereof to the elevated structure and extending downward to a lower end of the length of linked chain being fixed to the point of attachment on the device frame.

3. The system of claim 1 wherein the cam buckle is spring loaded.

4. The system of claim 1 wherein a downward force by the strap serves to tighten the cam buckle on the strap.

5. The system of claim 1 wherein the coil power spring is coaxial with the spool and is positioned adjacent to the spool on the device frame.

* * * * *